US009975334B2

(12) United States Patent
Kodoi et al.

(10) Patent No.: US 9,975,334 B2
(45) Date of Patent: May 22, 2018

(54) LIQUID DISCHARGING HEAD, LIQUID DISCHARGING APPARATUS, AND LIQUID SUCTION METHOD

(71) Applicant: CANON KABUSHIKI KAISHA, Tokyo (JP)

(72) Inventors: Takuma Kodoi, Kawasaki (JP); Masaki Oikawa, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/216,514

(22) Filed: Jul. 21, 2016

(65) Prior Publication Data

US 2017/0021627 A1 Jan. 26, 2017

(30) Foreign Application Priority Data

Jul. 24, 2015 (JP) ..... 2015-146462

(51) Int. Cl.

| | |
|---|---|
| ***B41J 2/14*** | (2006.01) |
| ***B41J 2/19*** | (2006.01) |
| ***B41J 2/165*** | (2006.01) |
| *B41J 2/045* | (2006.01) |

(52) U.S. Cl.

CPC ..... *B41J 2/14032* (2013.01); *B41J 2/14145* (2013.01); *B41J 2/16508* (2013.01); *B41J 2/19* (2013.01); *B41J 2/0458* (2013.01); *B41J 2002/14419* (2013.01); *B41J 2002/16502* (2013.01); *B41J 2202/07* (2013.01)

(58) Field of Classification Search

CPC ..... B41J 2/14032; B41J 2/19; B41J 2/14145; B41J 2/0458; B41J 2202/07; B41J 2002/14419; B41J 2002/16502

See application file for complete search history.

(56) References Cited

U.S. PATENT DOCUMENTS 6,231,167 B1 * 5/2001 Tsuboi ..... B41J 2/04563 347/17

2002/0036672 A1 * 3/2002 Courtney ..... B41J 2/1652 347/30

FOREIGN PATENT DOCUMENTS

| | | |
|---|---|---|
| JP | 2006-240150 A | 9/2006 |
| JP | 2007-030459 A | 2/2007 |

* cited by examiner

*Primary Examiner* — Geoffrey Mruk

(74) *Attorney, Agent, or Firm* — Canon U.S.A., Inc. IP Division

(57) ABSTRACT

A liquid discharging head includes a recording element board in which a plurality of discharge ports configured to discharge liquid are arrayed in a first direction, a support member configured to support the recording element board and including a common liquid chamber extending in the first direction to supply the liquid to the plurality of discharge ports and a buffer chamber configured to have an opening in a ceiling surface of the common liquid chamber opposed to the recording element board and to hold a bubble, and a heater located in a region of the recording element board opposed to a part of the ceiling surface extending from the opening of the buffer chamber to an end portion in the first direction and configured to generate heat when the liquid is not discharged from the plurality of discharge ports.

4 Claims, 7 Drawing Sheets

LIQUID DISCHARGING HEAD, LIQUID DISCHARGING APPARATUS, AND LIQUID SUCTION METHOD

BACKGROUND OF THE INVENTION

Field of the Invention

The present invention relates to a liquid discharging head that performs recording by discharging liquid, such as ink, toward various kinds of media, a liquid discharging apparatus, and a liquid suction method.

Description of the Related Art

A liquid discharging head, such as an inkjet head, includes a common liquid chamber that supplies liquid, such as ink, to a plurality of discharge ports. The common liquid chamber is connected to a liquid reservoir tank, and forms a part of a liquid flow passage extending from the liquid reservoir tank to the discharge ports. During liquid discharging, a meniscus of liquid repeats forward movement and backward movement near a discharge port. Rapid forward and backward movements of the meniscus deteriorate print quality. That is, when the meniscus moves forward, unexpected dispersion (splash) of the liquid from the discharge port may occur. When the meniscus moves backward, refilling the discharge port with the liquid is not quickly performed, and this may make it difficult to obtain sufficient discharging speed and discharging amount. Such rapid forward and backward movements of the meniscus are caused by a pressure fluctuation inside the common liquid chamber. In particular, the pressure in the common liquid chamber rises immediately after discharging of the liquid is completed.

Japanese Patent Laid-Open No. 2007-030459 discloses a liquid discharging head in which a buffer chamber is provided in a flow passage between a common liquid chamber and a liquid reservoir tank. Japanese Patent Laid-Open No. 2006-240150 discloses a liquid discharging head including a buffer chamber that has an opening in a wall of a common liquid chamber. The buffer chamber stores gas, and this suppresses a rapid pressure fluctuation inside the common liquid chamber.

In the liquid discharging head disclosed in Japanese Patent Laid-Open No. 2007-030459, since the buffer chamber is located far from discharge ports, the effect of suppressing the pressure fluctuation immediately after completion of liquid discharging is small, and it is difficult to sufficiently prevent defective printing. In the liquid discharging head disclosed in Japanese Patent Laid-Open No. 2006-240150, since the buffer chamber is located at a position near discharge ports, the effect of suppressing pressure fluctuation immediately after completion of liquid discharging is large. On the other hand, a bubble in the buffer chamber catches bubbles contained in liquid or the like, and grows with time. The grown bubble is partly peeled, and is ejected from the discharge port. If this phenomenon occurs during printing, the bubble clogs the discharge port, and discharging failure occurs.

Peeling of the bubble is promoted by flow of the liquid inside the common liquid chamber. For this reason, the bubble is hardly peeled but easily grows in a section where fluidity of the liquid is low. When a bubble having a large volume peels off a grown bubble, discharging failure is more likely to occur. Particularly in an end portion of the common liquid chamber and a region where the height of the common liquid chamber is small, a large bubble is easily produced because fluidity of the liquid is low.

SUMMARY OF THE INVENTION

The present invention provides a liquid discharging head in which a bubble hardly grows inside a buffer chamber, a liquid discharging apparatus, and a liquid suction method.

A liquid discharging head according to an aspect of the present invention includes a recording element board in which a plurality of discharge ports configured to discharge liquid are arrayed in a first direction, a support member configured to support the recording element board and including a common liquid chamber extending in the first direction to supply the liquid to the plurality of discharge ports and a buffer chamber configured to have an opening in a ceiling surface of the common liquid chamber opposed to the recording element board and to hold a bubble, and a heater located in a region of the recording element board opposed to a part of the ceiling surface extending from the opening of the buffer chamber to an end portion in the first direction and configured to generate heat when the liquid is not discharged from the plurality of discharge ports.

A liquid discharging head according to another aspect of the present invention includes a recording element board having a plurality of discharge ports configured to discharge liquid, a support member configured to support the recording element board and including a common liquid chamber configured to supply the liquid to the plurality of discharge ports, a buffer chamber configured to have an opening in a ceiling surface of the common liquid chamber opposed to the recording element board and to hold a bubble, and a liquid supply port configured to have an opening in the ceiling surface and to supply the liquid to the common liquid chamber, the ceiling surface including a first part located between the opening of the liquid supply port and the opening of the buffer chamber and a second part located on a side of the opening of the buffer chamber opposite from the first part and located at a shorter distance from the recording element board than the first part, and a heater located in a region of the recording element board opposed to the second part and configured to generate heat when the liquid is not discharged from the plurality of discharge ports.

Further features of the present invention will become apparent from the following description of exemplary embodiments with reference to the attached drawings.

DESCRIPTION OF THE EMBODIMENTS

Configurations of liquid discharging heads according to some embodiments of the present invention will be described with reference to the drawings. While the following embodiments relate to inkjet heads for discharging ink onto a recording medium, the present invention is not limited thereto, and can be widely applied to liquid discharging heads for discharging liquid. In the following description, a direction in which discharge ports are arrayed, that is, a direction in which a discharge port array extends is sometimes referred to as an x-direction or a first direction, a direction parallel to a discharge port formation surface and orthogonal to the x-direction is sometimes referred to as a y-direction, and a direction orthogonal to the x- and y-directions is sometimes referred to as a z-direction. While the x-direction or the first direction coincides with the longitudinal direction of a recording element board or a common liquid chamber in the embodiments, the present invention is not limited thereto. The z-direction is orthogonal to the discharge port formation surface, and coincides with a vertical direction in an installation state of a liquid discharging apparatus in which the liquid discharging head is assembled.

Figure 1:
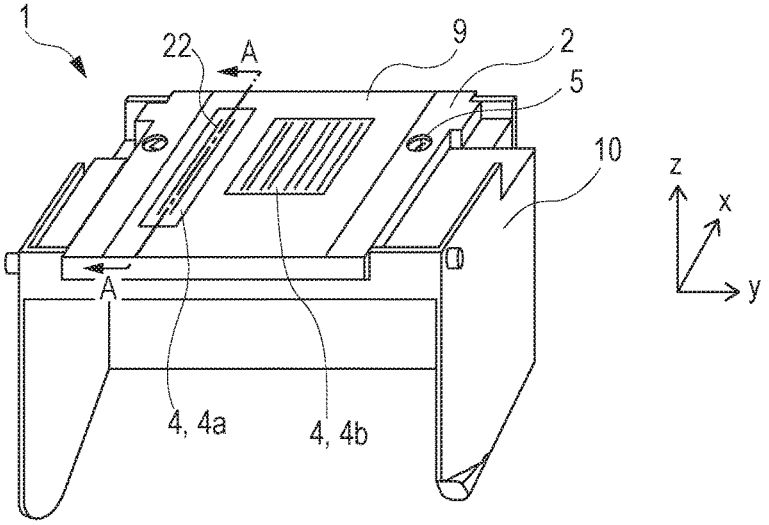
FIG. 1 is a perspective view of a liquid discharging head according to an embodiment of the present invention.
Figure 2A:
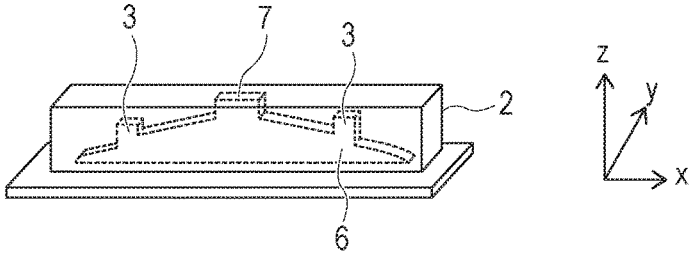
FIG. 2A is a perspective view of a support member.
Figure 2B:
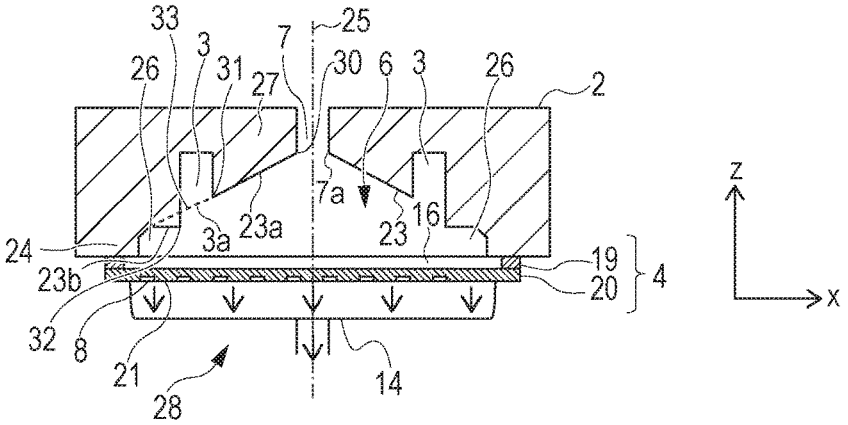
FIG. 2B is a cross-sectional view of the liquid discharging head, taken along line A-A of FIG. 1.

FIG. 1 is a perspective view of a liquid discharging head 1 according to an embodiment of the present invention. FIG. 2A is a perspective view of a support member, and schematically illustrates the shape of a common liquid chamber. FIG. 2B is a cross-sectional view of the liquid discharging head 1 taken along line A-A of FIG. 1 (a center line of the support member in the y-direction). The liquid discharging head 1 includes a housing 10 formed of resin, and a support member 2 similarly formed of resin and fixed to the housing 10 by screws 5. The housing 10 holds an ink tank (not illustrated). The support member 2 supports two recording element boards 4*a* and 4*b* extending in the x-direction. In the following description, each of the two recording element boards 4*a* and 4*b* is referred to as a recording element board 4. The support member 2 is provided with an electric wiring board 9. The electric wiring board 9 electrically connects heating resistance elements 18 (see FIG. 3) to a controller of a liquid discharging apparatus (not illustrated).

Figure 3:
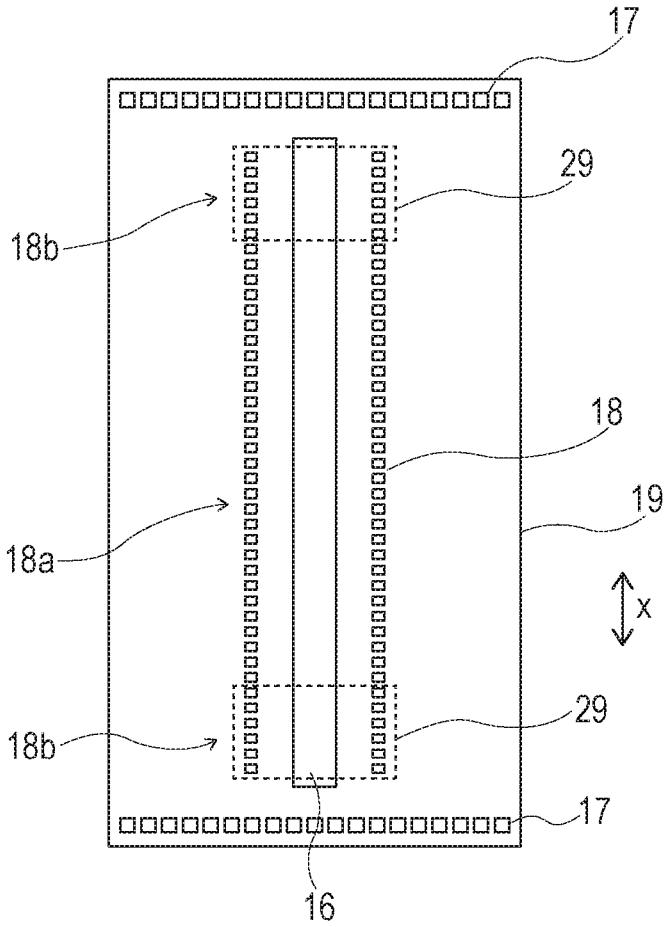
FIG. 3 is a plan view of a recording element board in the embodiment of the present invention.

Each recording element board 4 includes a substrate 19 and a discharge port formation substrate 20 bonded to the substrate 19. FIG. 3 is a plan view of the substrate 19 in the recording element board 4*a*. The substrate 19 has a plurality of heating resistance elements that apply discharging energy to ink. The heating resistance elements 18 are connected to contact pads 17 provided on both sides of the substrate 19 in the longitudinal direction (x-direction), and the contact pads are connected to the electric wiring board 9. A discharge port formation surface 21 of the discharge port formation substrate 20 has a plurality of discharge ports 8 from which liquid is discharged. The plurality of discharge ports 8 form discharge port arrays 22 extending in the longitudinal direction (x-direction) (see FIG. 1). The substrate 19 has an ink supply channel 16. Between the substrate 19 and the discharge port formation substrate 20, a pressure chamber (not illustrated) is provided to hold ink, and communicates with the ink supply channel 16 and the discharge ports 8. Ink supplied to the pressure chamber receives discharging energy from the heating resistance elements 18, and is discharged from the discharge ports 8. The viscosity of the ink decreases as the temperature rises.

The support member 2 has a common liquid chamber that supplies liquid to the discharge port arrays 22. The common liquid chamber 6 extends in the longitudinal direction serving as the x-direction, and is connected to the ink supply channel 16 of the substrate 19. The common liquid chamber 6 is defined by the recording element board 4, a ceiling surface 23 opposed to the recording element board 4, and side walls 24 that connect the ceiling surface to the recording element board 4. The z-direction distance from the ceiling surface 23 to the recording element board 4 is the longest in a longitudinal center portion 25 and is the shortest in both longitudinal end portions 26. Therefore, the common liquid chamber 6 is nearly shaped like an isosceles triangle whose bottom side is formed by the recording element board 4, when viewed from the y-direction. In the longitudinal center portion 25 of the ceiling surface 23 where the z-direction distance to the recording element board 4 is the longest, a liquid supply port 7 is provided to supply liquid to the common liquid chamber 6 therethrough. The liquid supply port 7 penetrates a ceiling plate 27 of the support member 2 that forms the ceiling surface 23, and is connected to the ink tank supported by the housing 10. The support member 2 can be produced using a metallic die. Alternatively, the support member 2 can be produced by compacting powder with a press.

On both longitudinal sides of the liquid supply port 7, that is, between the liquid supply port 7 and the longitudinal end portions 26 of the ceiling surface 23, two buffer chambers 3 are open. The buffer chambers 3 extend in the vertical direction z, and end in a middle portion of the support member 2. That is, the buffer chambers 3 are dead-end spaces having openings only in the ceiling surface 23. The buffer chambers 3 hold bubbles. Pressure vibrations of ink are induced in the common liquid chamber 6 for the purpose of flow of the ink during printing. The bubbles in the buffer chambers 3 reduce these pressure vibrations by expanding when the pressure decreases and shrinking when the pressure increases. The bubble in the buffer chambers 3 also absorb a rapid change in negative pressure inside the common liquid chamber 6 when the ink is discharged from the discharge ports 8 at a high frequency.

The ceiling surface 23 includes first parts 23*a* located between an opening 7*a* of the liquid supply port 7 and openings 3*a* of the buffer chambers 3 and second parts 23*b* located between the openings 3*a* of the buffer chambers 3 and the longitudinal end portions 26. The second parts 23*b* are located on sides of the openings 3*a* of the buffer chambers 3 opposite from the first parts 23*a*, and the z-direction distance from the second parts 23*b* to the recording element board 4 is shorter than that of the first parts 23*a*. While the first and second parts 23*a* and 23*b* are flat surfaces, they may be curved or may have irregularities.

After the ink is not discharged for a fixed time, it may not be normally discharged owing to clogging or thickening thereof. For this reason, the liquid discharging apparatus is provided with a suction mechanism that sucks ink from the discharge port arrays 22. Specifically, the liquid discharging head 1 is retracted to a predetermined region and preliminary discharging is performed to discharge the ink from the discharge ports 8 at regular intervals or before or after a recording operation. At this time, the ink is forcibly discharged from the liquid discharging head 1 by bringing a cap 14 of the suction mechanism 28 into contact with the discharge port formation surface 21 to cover the plurality of discharge ports 8 and operating a suction pump (not illustrated) connected to the cap 14. This recovers discharging performance of the liquid discharging head 1 and allows normal discharging. These series of operations are referred to as a suction recovery operation.

Next, states of bubbles in the buffer chambers 3 will be described with reference to FIGS. 2B and 4A to 4E. FIGS. 4A to 4E are cross-sectional views taken along line A-A of FIG. 1, similarly to FIG. 2B, and schematically illustrate the states of bubbles inside the common liquid chamber 6.

Figure 4A:
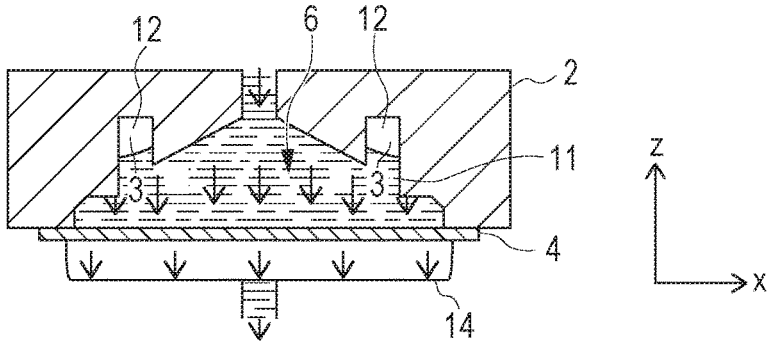
FIGS. 4A to 4E are schematic cross-sectional views illustrating states of bubbles in buffer chambers.
Figure 4B:
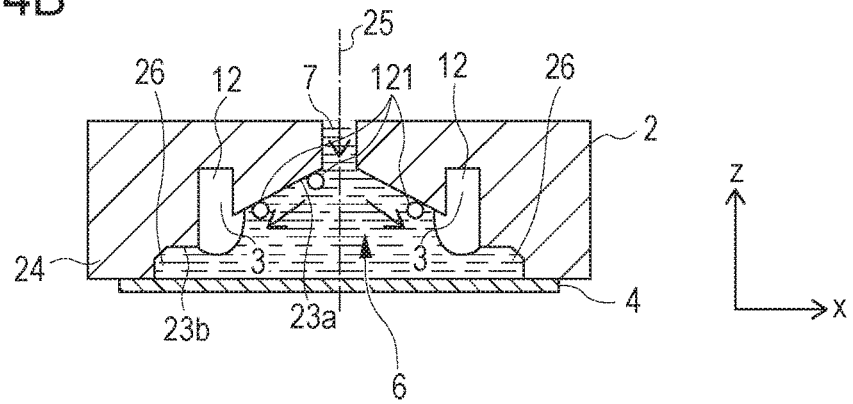

FIG. 2B illustrates an initial state in which the common liquid chamber 6 is not filled with ink. When the liquid discharging apparatus is first used, the cap 14 of the suction mechanism 28 is pressed against the discharge port formation surface 21 of the recording element board 4 to depressurize the common liquid chamber 6. Ink 11 is thereby supplied from the liquid supply port 7 to the common liquid chamber 6 (initial filling). The liquid discharging apparatus is installed in a use posture, that is, in a posture such that the discharge ports 8 face downward in the vertical direction. Since the buffer chambers 3 extend upward in the vertical direction from the openings 3*a* in the common liquid chamber 6, they are not filled with the ink 11. Therefore, as illustrated in FIG. 4A, when the ink 11 is supplied to the common liquid chamber 6, bubbles 12 stay in the buffer chambers 3. In the initial filling, air present in the buffer chambers 3 remains in the buffer chambers 3, and, for example, bubbles generated in the ink supply channel, latent bubbles in various members, and bubbles dissolved in the ink 11 shift to the buffer chambers 3 and are accumulated therein. While the bubbles 12 accumulated in the buffer chambers 3 sometimes partly protrude from the buffer chambers 3, they are stably held in the buffer chambers 3. After that, for example, a printing operation and a suction recovery operation are repeated, and, for example, dissolved bubbles 121 in the ink 11 are further accumulated in the buffer chambers 3. As a result, as illustrated in FIG. 4B, the bubbles 12 grow and partly protrude from the buffer chambers 3.

When printing is further performed in this state, the parts of the bubbles 12 protruding outside from the buffer chambers 3 peel at a certain time, and the peeled parts of the bubbles 12 are brought toward the discharge ports 8 by the ink 11. The bubbles 12 entering the discharge ports 8 hinder refilling of the ink 11, and this causes defective printing. Further, the following problem is caused because of the shape of the common liquid chamber and the positional relationship between the buffer chambers 3 in the common liquid chamber 6.

The height in the z-direction (the cross-sectional area) of the second parts 23*b* of the ceiling surface 23 is less than that of the first parts 23*a*. That is, the inertial resistance of the second parts 23*b* is lower than that of the first parts 23*a*, and the ink 11 less easily moves than at the first parts 23*a*. In other words, the common liquid chamber 6 includes first regions 23*a* having a relatively high inertial resistance and second regions 23*b* having a relatively low inertial resistance. The openings 3*a* of the buffer chambers 3 are disposed in the first regions 23*a*. When a suction recovery operation or preliminary discharging is performed, since the volume is small in the portions near the longitudinal end portions 26 of the common liquid chamber 6, fluidity of the ink 11 becomes lower than in the other portions. Since the portions near the longitudinal end portions 26 of the common liquid chamber 6 also face the side walls 24 of the common liquid chamber 6, the fluidity of the ink 11 further worsens. In contrast, the flow velocity of the ink 11 is high in a portion near the liquid supply port 7. This is because the ink 11 is introduced from the liquid supply port 7 and the height in the z-direction of the common liquid chamber 6 is large in the portion near the liquid supply port 7. The ink 11 mainly flows near the longitudinal center portion 25 of the common liquid chamber 6, and stays near the longitudinal end portions 26 closer to the ends than the buffer chambers 3. Thus, the force of peeling the bubbles 12 in the buffer chambers 3 is not sufficiently applied, and the bubbles 12 continue growth. When the grown bubbles 12 partly peel with a large volume, not only large bubbles 12 invade in the discharge ports 8, but also the ink 11 is not supplied in time in the longitudinal end portions 26 of the common liquid chamber 6. As a result, refilling of the discharge ports 8 in the longitudinal end portions 26 is not sufficiently performed, and this is likely to cause defective printing.

Figure 4C:
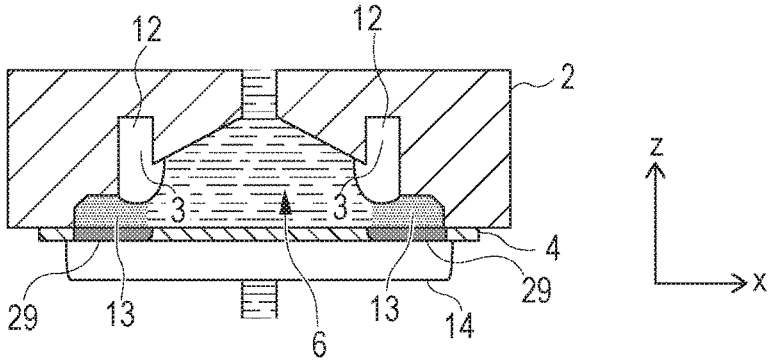
Figure 4D:
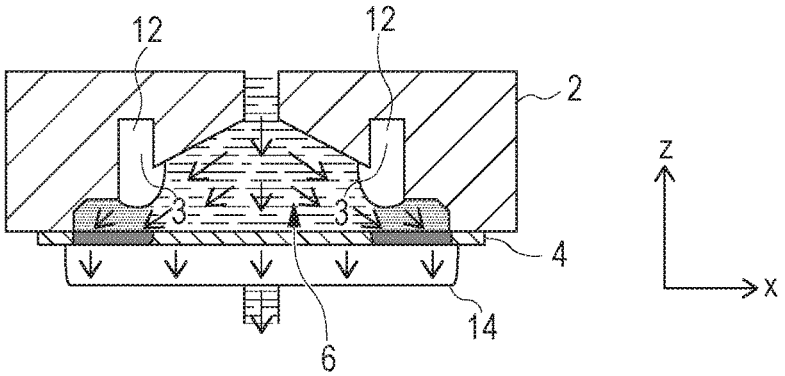
Figure 4E:
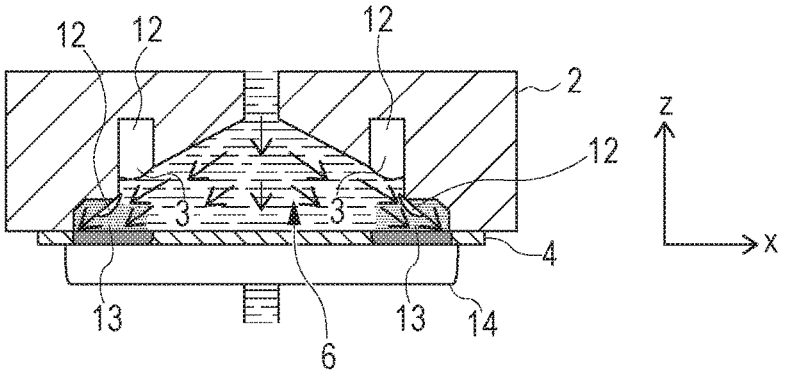

For this reason, in this embodiment, as illustrated in FIG. 4C, when the liquid is not discharged from the discharge port arrays 22, the heating resistance elements 18 heat regions of the recording element board 4 opposed to the second parts 23*b* in the z-direction (hereinafter referred to as heating regions 29). In other words, the heating resistance elements 18 formed by heaters serving as a heating unit are provided in the heating regions 29 of the recording element board 4 opposed to portions of the ceiling surface 23 from the openings 3*a* of the buffer chambers 3 to the longitudinal end portions 26 in the x-direction, and generate heat to heat the heating regions 29. As a result, the heating resistance elements 18 heat liquid in regions 13 of the common liquid chamber 6 extending from the openings 3*a* of the buffer chambers 3 to the longitudinal end portions 26 in the longitudinal direction x. The recording element board 4 is heated to a higher temperature inside the heating regions 29 than outside the heating regions 29, and the temperature of the ink 11 in the regions 13 opposed to the heating regions 29 of the common liquid chamber 6 becomes higher than that of the ink 11 in the other portions. Thus, viscosity of the ink 11 in the portions of the common liquid chamber 6 opposed to the heating regions 29 decreases, and fluidity of the ink 11 increases. Since peeling of the bubbles 12 is promoted by the flow of the ink 11, the possibility that the bubbles 12 peel before growing large is increased by increasing the fluidity of the ink 11 staying in the longitudinal end portions 26. After that, as illustrated in FIG. 4D, the suction mechanism 28 is operated to introduce the ink 11 from the liquid supply port 7 into the common liquid chamber 6 and to cause the ink 11 to flow in the common liquid chamber 6. The heating resistance elements 18 can also be operated during operation of the suction mechanism 28. After that, as illustrated in FIG. 4E, the bubbles 12 are peeled by the flow of the ink 11, pass through the discharge ports 8, and are sucked by the suction mechanism 28. While the bubbles 12 are peeled at a timing illustrated in FIG. 4E, they do not always need to be peeled at this timing. In the present invention, however, parts of the bubbles 12 easily peel before growth, and easily peel during operation of the suction mechanism 28.

While the ink 11 is heated before and during operation of the suction mechanism 28, that is, before the start of suction and during a period in which suction is performed in this embodiment, it can be heated at least before or during the operation of the suction mechanism 28. While the heating resistance elements 18 are used for the original ink discharging purpose and the ink heating purpose peculiar to the present invention in the embodiment, the ink 11 is not discharged during heating. The printing operation is also not performed during the operation of the suction mechanism 28. Since the operation of the heating resistance elements 18 for heating the ink 11 is thus performed out of the printing operation, it is possible to decrease the probability that the bubbles 12 peel during the printing operation and cause defective printing.

When the longitudinal end portions 26 of the common liquid chamber 6 are heated, a voltage lower than the voltage in preliminary discharging and printing is applied to the heating resistance elements 18 so that the ink 11 is not discharged. That is, at this time, the heating amount of the heating resistance elements 18 is smaller than the heating amount for applying discharging energy to the liquid. Here, the heating resistance elements 18 located outside the heating regions 29 are referred to as first heating resistance elements 18*a*, and the heating resistance elements 18 located inside the heating regions 29 are referred to as second heating resistance elements 18*b* (see FIG. 3). At this time, the above-described predetermined voltage is applied to the second heating resistance elements 18*b* to cause the recording element board 4 to generate heat. While the first heating resistance elements 18*a* do not always need to be operated, when they are operated, the second heating resistance elements 18*b* generate heat with a larger heating amount than the first heating resistance elements 18*a*. Further, to form a temperature gradient such that the temperature of the recording element board 4 becomes the highest in the longitudinal end portions 26, the heating amount of the second heating resistance elements 18*b* may be increased as the distance to the longitudinal end portions 26 decreases. To form the above temperature gradient, the time for which current flows through the heating resistance elements 18 may be increased as the distance from the second heating resistance elements 18*b* to the longitudinal end portions 26 decreases. Both the voltage applied to the heating resistance elements 18 and the time for which the current flows through the heating resistance elements 18 may be controlled.

In this embodiment, intersections 32 of the second parts 23*b* and the buffer chambers 3 are located closer to the recording element board 4 than extension lines 33 of lines that connect intersections 30 of the first parts 23*a* and the liquid supply port 7 and intersections 31 of the first parts 23*a* and the buffer chambers 3. In other words, portions of the buffer chambers 3 on the sides of the longitudinal end portions 26 are located closer to the recording element board 4 than extension surfaces of the first parts 23*a* of the ceiling surface 23. Thus, bubbles easily peel before they glow large.

Figure 5A:
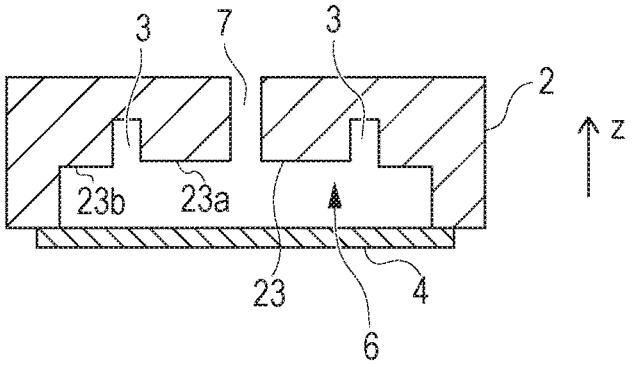
FIG. 5A to 5E are schematic cross-sectional views illustrating various modes of a common liquid chamber.
Figure 5B:
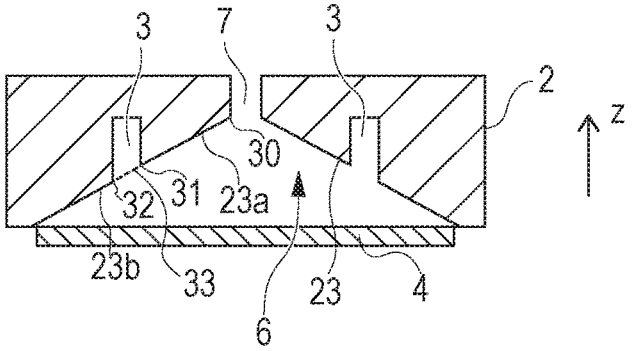
Figure 5C:
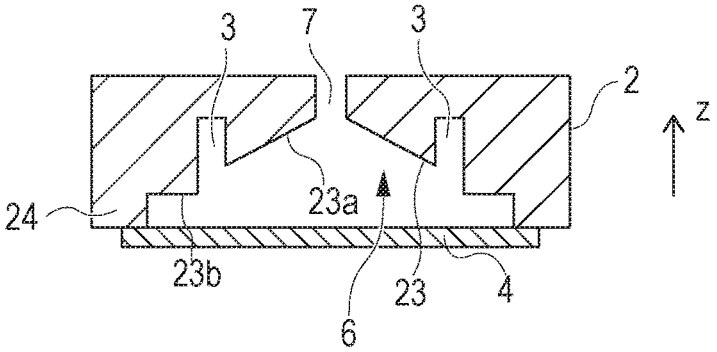
Figure 5D:
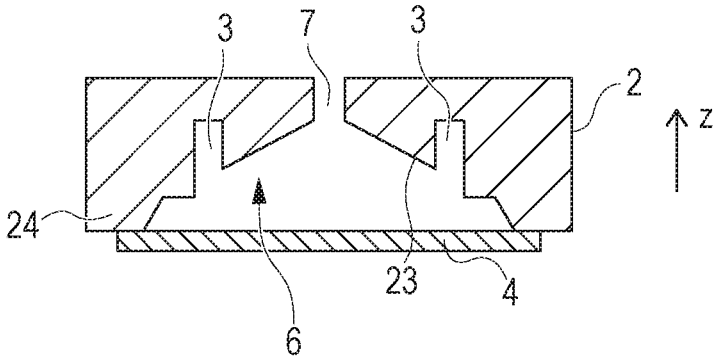
Figure 5E:
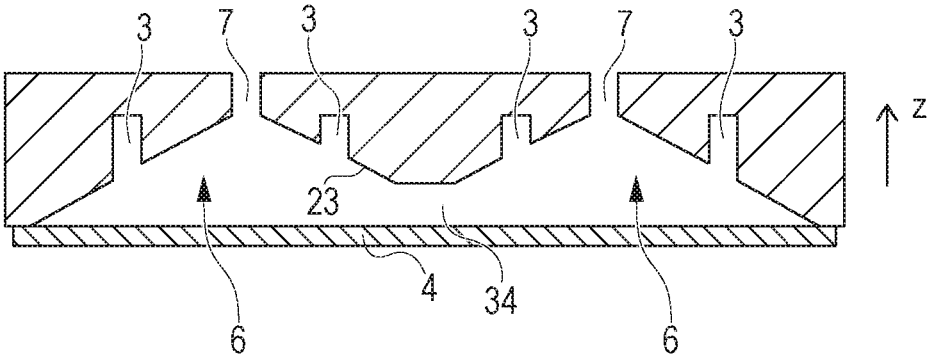

FIGS. 5A to 5E illustrate various shapes of the common liquid chamber 6. Referring to FIG. 5A, the ceiling surface 23 is parallel to the recording element board 4, and heights of the first parts 23*a* and the second parts 23*b* of the ceiling surface 23 are fixed in the z-direction. Referring to FIG. 5B, each first part 23*a* and each second part 23*b* of the ceiling surface 23 are located on one flat surface. That is, the intersections 32 of the second parts 23*b* and the buffer chambers 3 are located on the extension lines 33 of the lines that connect the intersections 30 of the first parts 23*a* and the liquid supply port 7 and the intersections 31 of the first parts 23*a* and the buffer chambers 3. Referring to FIG. 5C, the second parts 23*b* of the ceiling surface 23 are in direct contact with the side walls 24. Referring to FIG. 5D, surfaces of the side walls 24 facing the common liquid chamber 6 are inclined toward the longitudinal center portion 25 of the common liquid chamber 6. Referring to FIG. 5E, two common liquid chambers 6 having the shape of FIG. 5B communicate with each other with a connecting portion (narrow portion) 34 being disposed therebetween. In any of the common liquid chambers 6 illustrated in FIGS. 5A to 5E, the portions near the longitudinal end portions 26 are close to the ceiling surface 23 and the side walls 24, and fluidity of ink is low therein. Therefore, a similar effect can be exerted by heating the portions of the recording element board 4 near the longitudinal end portions 26, as described above. Particularly in the common liquid chamber 6 illustrated in FIG. 5B, the height of the common liquid chamber 6 in the z-direction continuously decreases toward the longitudinal end portions 26 of the common liquid chamber 6, and fluidity of the ink is significantly low in the longitudinal end portions 26. For this reason, the recording element board 4 is heated to have a temperature gradient such that the temperature thereof continuously increases toward the longitudinal end portions 26. In the common liquid chambers 6 illustrated in FIG. 5E, since fluidity of ink is the lowest in the longitudinal end portions 26, the recording element board 4 is heated to have a temperature gradient such that the temperature thereof continuously increases toward the longitudinal end portions 26. At the same time, the recording element board 4 is heated so that the temperature thereof is higher near the center connecting portion 34 than directly below the liquid supply ports 7.

Figure 6:
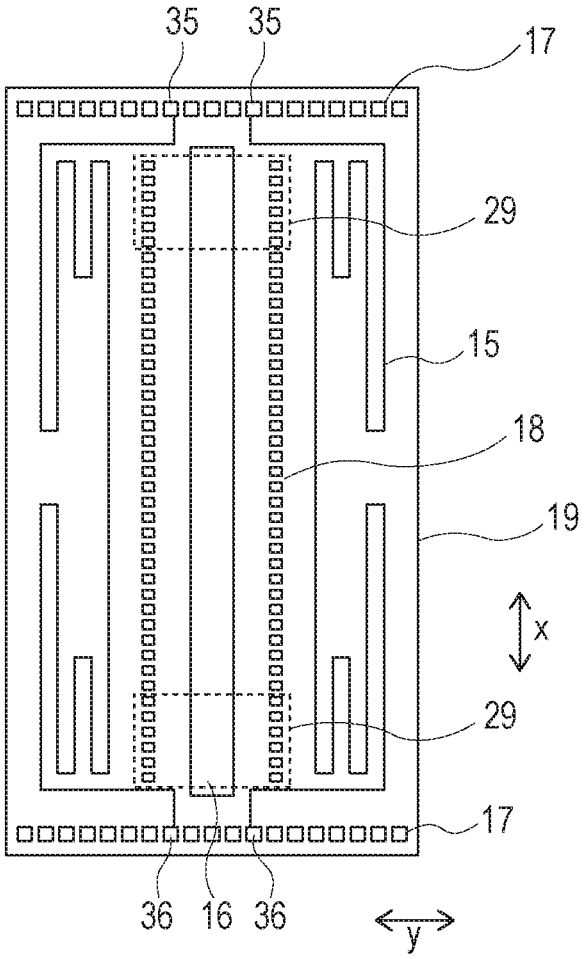
FIG. 6 is a plan view of a recording element board according to another embodiment of the present invention.

FIG. 6 illustrates heaters in a recording element board 4 according to another embodiment. In the above-described embodiment, the heating resistance elements 18 also function as the heaters for heating the recording element board 4. In contrast, in this embodiment, wires provided separately from a plurality of heating resistance elements 18 and capable of generating heat (hereinafter referred to as heating wires 15) are incorporated in regions of a recording element board 4 opposed to second parts 23*b* or heating regions 29. One heating wire 15 is provided on each side of an ink supply channel 16. Each heating wire 15 is one wire that connects an electrode 35 on one side and an electrode 36 on the other side, and makes several turns in the x-direction in the heating regions 29. Therefore, the arrangement density of the heating wire 15 is higher inside the heating regions 29 than outside the heating regions 29. The arrangement density is a value obtained by dividing the number of heating wires 15 passing in a cross section of the recording element board 4 taken along the y-direction by the cross-sectional area. Instead of providing one heating wire 15, some heating wires may be provided to extend from the electrode on one side, to turn back before reaching the longitudinal center portion, and to return to the electrode on the one side. The position where the heating wire 15 is provided is not limited to the recording element board 4 as long as it can heat ink 11 in regions extending from openings 3*a* of buffer chambers 3 to longitudinal end portions 26. The heating wire 15 may be provided in a support member 2.

Although the present invention can be applied to the liquid discharging head that discharges liquid, it can be suitably applied particularly to a long liquid discharging head in which the length of a recording element board exceeds one inch and there is much variation in the flow of ink inside a common liquid chamber. The present invention is also suitably applicable to a liquid discharging head in which low-viscosity ink is supplied at high velocity because of high-speed driving. This is because pressure vibrations of the low-viscosity ink inside the common liquid chamber are large and the volume of bubbles held in buffer chambers needs to be kept constant. When heat-retention driving is performed to maintain a predetermined temperature of the ink, there is a tendency to decrease the viscosity of the ink and to increase pressure vibrations inside the common liquid chamber. Hence, the present invention can be suitably applied to such a case. The present invention can also be suitably applied to a case in which the support member is formed of a resin having a small thermal capacity, because the temperature of the ink is likely to rise. The present invention can also be suitably applied to a case in which the support member is formed of a metal having a large thermal capacity.

In the present invention, the heating regions 13 are not limited to the ones in the above-described embodiments. In the present invention, when the buffer chambers are provided in the regions of the common liquid chamber 6 where the ink relatively hardly moves, the temperature of ink in the regions where the ink relatively hardly moves is made higher than the temperature of ink in the regions where the ink relatively easily moves by the heating unit. In the above-described embodiments, the regions where the ink relatively hardly moves are the first parts 23*a*, and the regions where the ink relatively easily moves are the second parts 23*b*. The present invention is applicable to the range that satisfies this condition. For example, the present invention can be suitably applied not only to the common liquid chamber having a triangular cross section in the above-described embodiments, but also to a common liquid chamber having a rectangular cross section when the height (in the z-direction) of the common liquid chamber is low and the length of the common liquid chamber in the x-direction is long. The region where the ink easily moves means that the inertial resistance is relatively low in the region, and the region where the ink hardly moves means that the internal resistance is relatively high in the region.

According to the above configurations, fluidity of the liquid increases near the buffer chambers of the common liquid chamber, and bubbles held in the buffer chambers partly and easily peel. For this reason, the size (amount) of the bubbles is adjusted, and the bubbles hardly grow inside the buffer chambers. Therefore, according to the present invention, it is possible to provide a liquid discharging head in which bubbles hardly grow large inside buffer chambers, a liquid discharging apparatus, and a liquid suction method.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-146462, filed Jul. 24, 2015, which is hereby incorporated by reference herein in its entirety.

What is claimed is:

1. A suction method for a liquid discharging apparatus including a liquid discharging head having a discharge port array in which a plurality of discharge ports configured to discharge liquid are arrayed in a first direction, a common liquid chamber configured to hold the liquid to be supplied to the discharge ports, and a buffer chamber having a chamber which is sealed except for an opening formed therein communicating with the common liquid chamber, the buffer chamber being configured to hold a bubble in the chamber, and a cap configured to cover the plurality of discharge ports, wherein the liquid in the common liquid chamber is sucked from the discharge ports in a state in which the discharge ports are covered with the cap, wherein the common liquid chamber includes a first region having a relatively high inertial resistance and a second region having a relatively low inertial resistance, wherein the opening of the buffer chamber is disposed in the first region, and wherein the liquid is sucked from the discharge ports via the cap in a state in which a temperature of the liquid in the first region is increased to be higher than a temperature of the liquid in the second region by heating the liquid in the common liquid chamber by a heating unit.

2. The suction method according to claim 1, wherein the heating unit is a heating resistance element configured to discharge the liquid from the discharge ports.

3. The suction method according to claim 1, wherein the heating unit performs heating before the suction starts.

4. The suction method according to claim 3, wherein the heating unit performs the heating before the suction starts and during a period in which the suction is performed.

* * * * *